US005305809A

United States Patent [19]

Pringle

[11] Patent Number: 5,305,809

[45] Date of Patent: Apr. 26, 1994

[54] GANG ARRAY FILLER WITH RELOCATABLE NOZZLES

[75] Inventor: Frank G. Pringle, Medford, N.J.

[73] Assignee: R & D Innovators, Inc., Medford, N.J.

[21] Appl. No.: 963,596

[22] Filed: Oct. 20, 1992

[51] Int. Cl.[5] ..... B65B 1/04; B65B 3/04; B65B 37/00

[52] U.S. Cl. ..... 141/235; 141/237; 141/177; 141/84; 141/157; 414/796.2

[58] Field of Search ..... 141/84, 177, 235, 156, 141/157, 159, 163, 168, 169, 170, 181, 237, 242, 243; 414/796.2, 796.3, 796.4, 796.8

[56] References Cited

U.S. PATENT DOCUMENTS

| | | | |
|---|---|---|---|
| 518,306 | 4/1893 | Clark | 141/237 |
| 662,087 | 11/1900 | Nichols et al. | 141/235 |
| 3,020,939 | 2/1962 | Donofrio | 141/169 |
| 3,612,299 | 2/1970 | Shaw et al. | 214/6 N |
| 3,651,836 | 3/1972 | Johnson | 141/103 |
| 3,888,364 | 6/1975 | Inoue et al. | 414/796.8 |
| 3,937,336 | 2/1976 | Carlson | 414/796.8 |
| 4,055,202 | 10/1977 | Greene | 141/59 |
| 4,073,322 | 2/1978 | Bennett | 141/181 |
| 4,270,584 | 6/1981 | Van Lieshut | 141/11 |
| 4,313,476 | 2/1982 | Bennett et al. | 141/181 |
| 4,411,295 | 10/1983 | Nutter | 141/59 |
| 4,493,349 | 1/1985 | Pomponio, Sr. | 141/59 |
| 4,603,896 | 8/1986 | Vasseur et al. | 294/2 |
| 4,621,969 | 11/1986 | Berghäll et al. | 414/331 |
| 5,159,960 | 11/1992 | Pringle | 141/1 |
| 5,168,905 | 12/1992 | Phallen | 141/103 |

*Primary Examiner*—Henry J. Recla
*Assistant Examiner*—Steven O. Douglas
*Attorney, Agent, or Firm*—Eckert Seamans Cherin & Mellott

[57] ABSTRACT

A filling machine for containers simultaneously fills an array of containers, for examples immediately following depalletizing, and includes motor driven positioners for the nozzles to accommodate changes in the size of container being run. The containers are laterally abutted to occupy evenly spaced container positions, and the array can be compressed by a contoured push bar to force the entire array into registry. The nozzles are flexibly coupled to a source of material to be discharged into the containers, and are mechanically moved by actuators that displace at least a subset of the nozzles along the axes of the array. In this way the nozzles are moved into registry with the container array. The nozzles are also vertically movable relative to the containers, and each includes a valve opened by contact with a respective container, for discharging only into occupied container positions and not voids in the array. The actuators include at least one motor drive to advance and retract the nozzles along at least one of the axes, and preferably the nozzles along particular rows and columns have a common positioning motor such as a threaded rod and nut arrangement.

18 Claims, 3 Drawing Sheets

GANG ARRAY FILLER WITH RELOCATABLE NOZZLES

BACKGROUND OF THE INVENTION

1. Field of the Invention

The invention relates to the field of fillers for containers carried axially upright on a conveyor in an X-Y array, and more particularly to a filler arranged for at least semiautomatic job changing from containers of one dimension to containers of another dimension. A plurality of individual nozzles in the array are re-positionable in the array such that when containers having a larger or smaller lateral dimension are to be run, the individual nozzles are movable into registry with the new array.

2. Prior Art

Filling machines for containers such as beverage bottles and the like conventionally pass the containers in a single file along a conveying path, with the containers opening axially upwardly for filling via nozzles that direct fluid or other material contents downwardly into the containers. High speed filling lines may have a rotary carousel with a number of filling nozzles guided by a cam. The carousel rotates to move the nozzles synchronously with the passing containers and the cam moves the nozzles downwardly to engage against the containers. Contact with a container causes the filler to discharge, for example via a valve in the respective nozzle opened by axial pressure with the end of the container or a neck of the container. U.S. Pat. No. 4,493,349—Pomponio, Sr. discloses a valve arrangement as described.

It is possible that a plurality of nozzles in a serial line filling machine may operate simultaneously to fill a number of adjacent containers in the stream, either by moving synchronously with the containers or by arranging for a group of containers to be stopped while they are filled. It is also possible that two serial lines of containers may be served by adjacent rows of filling nozzles. U.S. Pat. No. 3,651,836—Johnson discloses a filling machine that serves two parallel streams of containers using banks of four adjacent nozzles to serve four adjacent containers in each stream. Another example of a filler that fills a group of containers simultaneously is shown in U.S. Pat. No. 3,020,939—Donofrio.

It is necessary in a filling machine having spaced nozzles to ensure that the nozzles align in registry with the containers they are to fill. In a serial filling line, the sidewalls or rails of a conveyor, slide track or similar arrangement typically guide the bottles along the conveyor and prevent the containers from being displaced laterally of the direction of advance along the container stream. The sidewalls, rails or the like keep the centerlines of the containers along the centerline of the row of nozzles.

For linear positioning along the direction of advance, either each container is abutted directly against the longitudinally preceding and following container, or container-carrying pockets are provided at a fixed spacing, to ensure that the containers (and specifically the open tops of the containers) are at the same linear spacing as the nozzles. In Donofrio, the containers are urged laterally against a container sidewall and stopped longitudinally by a movable stop that obstructs the container path and thereby holds the containers in place while they are filled. A filler of this type, which handles groups of containers, can operate "continuously" by filling a first group and then the next adjacent group in a periodic cyclic motion. Typically the filling motion is simply an axial advance and retraction of one of the nozzles and the containers relative to the other, for discharging contents through the nozzles.

It could speed the filling of containers further if an entire X-Y array of containers is filled simultaneously. However, there are problems in adapting such an arrangement to high speed or continuous operation because of problems in ensuring that the containers in the array are in registry with the nozzles. As a result, gang filling tends to be much more of a batch operation than a continuous one.

Examples of gang filling an array of containers are disclosed in U.S. Pat. Nos. 4,055,202—Greene; 4,270,584—van Lieshout; and 4,411,295—Nutter. In each case a regular X-Y array of containers is provided that corresponds to an array of nozzles or fill heads. In Greene the containers are bottles; in van Lieshout they are open top cups for beer; and in Nutter the containers are 55 gallon drums having off-center fill holes.

In order to maintain array positions, Green holds the bottles in a box in which the bottles f it so closely as to occupy regular positions in mutually perpendicular directions when the box is full. If such a box is not entirely full the container positions are uncertain because the abutment of the containers is relied upon to position them. A similar situation could be obtained by defining receptacles for the containers, e.g., by webbing forming crossing walls between the outer walls of the box. The bottles must be moved axially into such receptacles or into the spaces between other bottles, suggesting a manual operation. In van Lieshout, beer cups are placed manually into a box nearby one another but spaced somewhat. The open tops of the cups provide a wide enough target for the nozzles that spacing is not critical, provided the cups are substantially regularly spaced, i.e., by a manual operation. In van Lieshout, one row is filled at a time. In Nutter, not only must the 55 gallon drums be in correct position, but additionally their fill openings must be turned to toward one another in groups of four, for aligning with a fill head having four discharge fittings. Manual attention to positioning is required.

Each of the foregoing gang filling arrangements requires manual attention to set the containers in position, and is not as suited to automation as the serial fillers mentioned above. Although it is helpful in Greene and van Lieshout that the containers are boxed as a part of this process, and can thereafter be handled as a unit, there is no practical way to position and fill a "bulk" group of containers automatically or semiautomatically by these methods.

In each of these prior art gang filling machines, the nozzles are fixed in position. For example in Greene, a tank is subdivided for measuring the amount to be discharged into each container and the valves comprise fixed structures coupled to the tank at the centerline of each receptacle. In van Lieshout, taps are fixed at the required positions along an arm disposed over the array, the fixed positions corresponding to the pitch of the container spacing. In order to use such a machine to fill containers of some other size, most or all of the filling structure would have to be replaced. Although soft drinks and beer may involve runs of a large number of bottles, if a relatively small number of containers are to be filled in a production run (e.g., as typical of liquor), rebuilding the filling machine or providing an additional filling machine are not cost justified.

Lightweight containers present special problems when one attempts to handle them in bulk. Containers such as polyethylene terephthalate or "PET" are inexpensive and durable, and the minimal weight of the material makes it attractive for shipping and handling. However, the containers very easily fall over when unsupported by adjacent containers and/or as a conveyor structure. Line operation speeds of linear filling lines must be slower than comparable filling lines running heavier, more stable glass containers. When handled in bulk, containers are prone to define an array with voids, and for PET containers the voids cause containers to fall over, requiring manual attention.

Bulk containers can be nested in a regular array by laterally inward pressure on the group. By engaging the outermost rows of containers in an array using a scaled bar, as disclosed in copending application Ser. No. 07/957,413, filed Oct. 5, 1992 and entitled CONTAINER FILLER, ESPECIALLY FOR BALLAST, HAVING CONTOURED SWEEP FOR ARRAYING CONTAINERS, which is hereby fully incorporated by reference, it is possible to use the shape of the outermost containers to engage the inner containers in a similar fashion, forcing all the containers to assume positions in a regular array. For containers having a round cross section, adjacent rows or columns are staggered. For other cross sections, other arrays are possible.

Whether the containers are arranged in bulk or in regularly spaced receptacles of one kind or another, a minimum spacing between the centerlines of the containers is defined by the lateral size of the containers. The filling openings of larger sized containers are necessarily spaced by a greater minimum distance than the filling openings of smaller containers. Although it would be possible to build a gang filling machine with nozzles aligned to the largest possible containers, running smaller containers on the filling machine would require substantial steps to ensure that the smaller containers are presented in registry with the filling nozzles. This would waste packing and processing space (e.g., in receptacle carrier boxes) or would require some additional means to position the individual containers at the correct distance along two mutually perpendicular axes. When conducting a job change, new (narrower) conveyor structures would be needed. Although this could be accomplished, the change would be most cumbersome. The conveyor guides could be brought closer together and a new understructure having means to linearly space the containers would be needed.

Conversely, one could provide a gang filling machine having nozzles arranged for the smallest containers arranged in the most densely packed possible array, and then only use those nozzles which align with the openings of larger containers. Whereas the nozzles typically do not discharge unless they contact a container, such an arrangement would be possible with careful planning of the various sizes of containers to be run. More particularly, larger containers would need to be wider than smaller ones by a planned amount (e.g., in multiples of uneven numbers), so that the centerlines of the larger containers would fall at the same points as smaller ones. This solution to the problem is also cumbersome, as well as expensive because many of the nozzles would routinely go unused.

A gang filling machine is needed that more efficiently solves the problems of providing a regular array of containers that corresponds to a regular array of nozzles, and can be quickly and conveniently set up to run containers of varying sizes.

SUMMARY OF THE INVENTION

It is an object of the invention to provide a gang filling machine that is adapted for job changes, enabling filling containers of different sizes with minimal changes to the filling machine apparatus.

It is another object of the invention to provide a gang filling machine that operates optimally with containers that are presented in bulk.

It is a further object of the invention to enable cost justified runs of small numbers of containers, which may be of non-standard sizes.

It is still another object of the invention to provide a means for automatically re-positioning the nozzles in an array of nozzles, using actuators that are independently controllable and/or controllable in ranks, for positioning the nozzles in registry with container openings of various sizes to be filled.

These and other objects are accomplished by a filling machine for containers that simultaneously fills an array of containers, for example immediately following depalletizing, and includes motor driven positioners for the nozzles to accommodate changes in the size of container being run. The containers are laterally abutted to occupy evenly spaced container positions, and the array can be compressed by a contoured push bar to force the entire array into registry. The nozzles are flexibly coupled to a source of material to be discharged into the containers, and are mechanically moved by actuators that displace at least a subset of the nozzles along the axes of the array. In this way the nozzles are moved into registry with the container array. The nozzles are also vertically movable relative to the containers, and each includes a valve opened by contact with a respective container, for discharging only into occupied container positions and not voids in the array. The actuators include at least one motor drive to advance and retract the nozzles along at least one of the axes, and preferably the nozzles along particular rows and columns have a common positioning motor such as a threaded rod and nut arrangement.

BRIEF DESCRIPTION OF THE DRAWINGS

There are shown in the drawings certain exemplary embodiments of the invention as presently preferred. The invention is not limited to the examples, which are presented to provide a better understanding of the invention as defined in the appended claims. In the drawings.

DETAILED DESCRIPTION OF THE PREFERRED EMBODIMENTS

Figure 1:
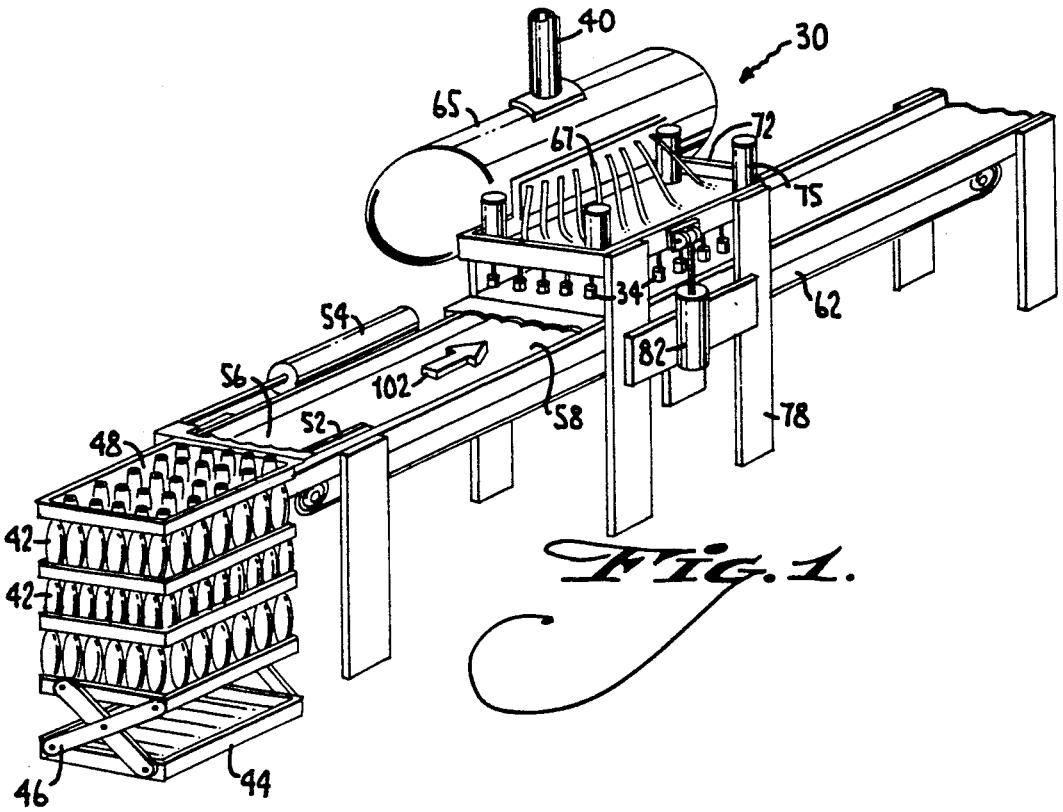
FIG. 1 is a schematic perspective view of a filling machine according to the invention.

The invention seeks to improve efficiency and throughput by simultaneously filling an array 20 of containers 22. The array is loaded and positioned automatically at a filling station 30 with the array being first packed or arranged such that each container 22 occupies one of the regularly spaced positions 32 in a regular array. The filling station 30 has nozzles 34 arranged in registry with the regular array, which are operated when the containers 22 are in place to discharge material from a source 40 to the containers.

Referring to FIG. 1, the containers 22 can be supplied from stacked ranks 42 of containers from a depalletizer 44. The depalletizer has a vertical displacement means 46 arranged to raise each rank 42 into a position 48 where the rank is encompassed by an extended sweep mechanism 52 driven by a pneumatic cylinder 54 or the like, for pulling the containers 22 onto the surface 56 of a conveyor 58. The conveyor has sufficient lateral dimension to accommodate the width of the X-Y array 20 of containers 22 as they are moved to the filling station 30. The conveyor 58 may have an endless belt 62 for advancing the array under power of a motor (not shown) when pulled onto the conveyor surface 56 by the sweep 52 as shown. Alternatively the conveyor may be simply a sliding surface, in which case the sweep 52 must have a sufficient stroke length to move the array 20 into position at the filling station 30.

The array 20 of containers 22 need be of no particular length or width; however for purposes of efficiency it is desirable that a large number of containers be handled and filled at once. At the filling station 30, the conveyor or sliding surface 56 supports the containers 22 in an upright orientation with the containers occupying a plurality of evenly spaced container positions along at least one longitudinal axis of an array of the containers, and preferably along two mutually perpendicular axes. In other words, the array is preferably a reasonably large number of containers on a side.

The containers 22 can be glass, plastic or the like. An advantageous container for use with the invention is a polyethylene terephthalate or PET container, which is light and durable, but which falls over easily, particular at downstream parts of the process (not shown) where the containers 22 may be forced by narrowing conveyor sidewalls from an X-Y array into single file. By gang filling the containers 22 in the area of the depalletizer 44, the contents of the filled containers renders them much more stable and substantially solves any problems with containers falling over.

The plurality of nozzles 34 are relatively movable individually in directions parallel to the plane of the array 20, for setting the nozzles in registry with predetermined positions which the containers 22 occupy in a regular pattern, e.g., a packed array in which the containers abut one another with minimum spaces defined between them. After being positioned in this manner for a given size of container, the nozzles 34 are moved as a group vertically downward against the containers for filling, then upwardly away from the containers for clearance, as each successive rank or group of containers is brought into position, filled and then moved on down the conveyor for capping or the like.

The nozzles 34 are coupled to a source of material to be discharged into the containers 22, such as a tank 65 of liquid to which the nozzles 34 are connected by suitable flexible conduits 67. The flexible conduits 67 allow the nozzles 34 to be moved relative to their mounting structures and relative to the source. The source 65 can be fixed in position or coupled to move vertically together with the positioned nozzles 34.

For vertically moving the nozzles, a supporting framework 72 for the nozzles 34 is mounted via vertical slide shafts 75 to fixed legs 78 or the like attached to the conveyor 58. A pneumatic cylinder 82 moves the framework upwardly or releases it for downward displacement by gravity, or alternatively, the pneumatic cylinder 82 can drive the framework 72 in both directions. When the framework 72 carries the nozzles 34 downwardly against the containers 22, the respective nozzles 34 open to discharge material from the source 65 into the containers 22.

Actuator means 90 are mounted on the fill station structure and arranged controllably to displace at least a subset of the nozzles 34 parallel to the longitudinal axis 102 of container advance along the conveyor, and preferably along both longitudinal and lateral axes. The actuator means 90 is thereby operable to alter the nozzle positions for achieving at least two alternative spacings of the nozzles 34, corresponding to evenly spaced container positions of containers of at least two different sizes.

The conveyor or other means for supporting the containers in an upright orientation arranges the containers 22 in an array wherein each container occupies one of a plurality of evenly spaced container positions in the X-Y array extending along the mutually perpendicular longitudinal and lateral axes of the array.

Figure 2:
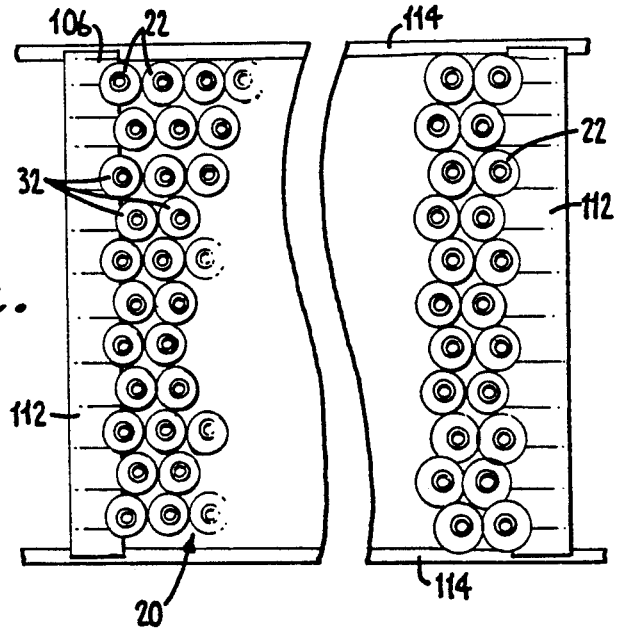
FIG. 2 is a plan view showing an X-Y array of containers engaged by a contoured bar for fixing their positions in the array.

Preferably, the containers 22 are arranged such that they directly abut one another in the array 20, as shown for example in FIG. 2. Where the containers are round as shown, the most packed form of array is such that the containers 22 in adjacent rows 104 (or columns 106) are staggered. It would also be possible to arrange the containers 22 in a precisely rectangular array of positions, for example if the containers are carried in a box, placed in receptacles on a movable platform, or otherwise bound in place. However by staggering every other row as shown, the containers 22 function to force one another into the regular positions. Lateral pressure exerted on the array 20 thus closely packs the array and causes each of the containers 22 to assume one of the regular positions even if isolated voids remain in the array, where no container is present.

For forcing the containers into the predetermined array, at least one laterally movable bar 112 is operable to urge the containers 22 laterally inwardly toward the center of the array 20. In FIG. 2, two opposed bars 112 are movable to exert inward pressure in a direction parallel to the direction 102 of advance of the array 20. The two remaining borders defining the periphery of the array are defined by fixed conveyor sidewalls 114.

The movable bars 112 can be slidable via pneumatic cylinders (not shown) and/or pivotable relative to the containers 22 to permit the containers to pass. Alternatively, the bars 112 can advance from the sides of the conveyor, in which case additional movable bars are needed to engage the front and rear of the array in the direction of advance.

The movable bars 112 are contoured to complement a peripheral column or row 122 of the array 20 as packed. In FIG. 2, the left side of the drawing shows the packed array and the right side shows the condition of the array in the process of being packed. The bars 112 engage and position the first containers encountered as the bars 112 and the array 20 are relatively moved toward one another. These engaged containers are positively positioned due to the contour of bars 112, and thus define a contour for the packed positions of the next inward column or row. As the bars progressively constrict the array 20, each of the containers 22 is forced into one of the positions of the packed array. These positions are in registry with the nozzles 34 of the filling station 30.

This packing arrangement is substantially as defined in copending patent application Ser. No. 07/957,413, filed Oct. 5, 1992 and entitled CONTAINER FILLER, ESPECIALLY FOR BALLAST, HAVING CONTOURED SWEEP FOR ARRAYING CONTAINERS, which is hereby fully incorporated by reference. The contoured bars force the containers into one of the defined positions along both perpendicular axes, even if isolated voids remain in the array as a whole, where no container is present.

As the vertical drive means 82 raises and lowers the movable support framework 72 relative to the containers 22 (or perhaps raises and lowers the containers relative to the supporting structure), the nozzles 34 engage with the open tops 130 of the containers 22. The nozzles 34 each include an axially operated valve 135 that is spring biased to close and is opened by contact with a container 22. If a given nozzle 34 encounters a void instead of a container, its valve 135 remains closed.

Figure 3:
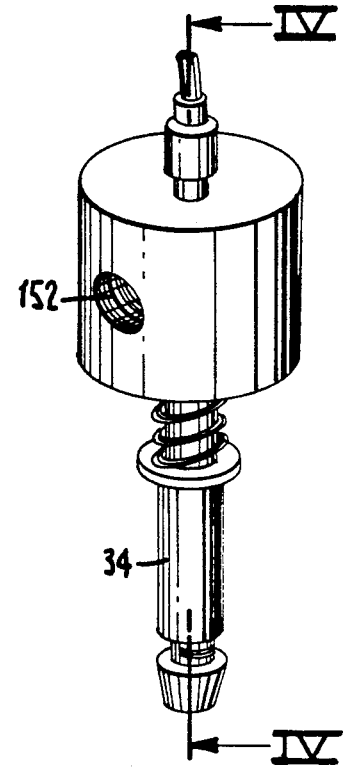
FIG. 3 is a perspective view showing an individual filling nozzle.
Figure 4:
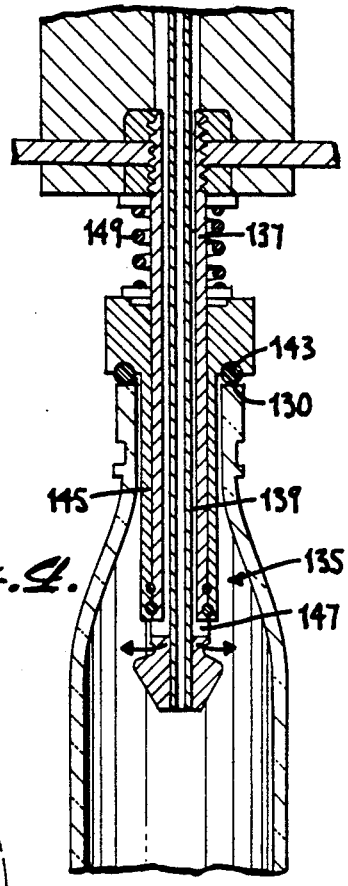
FIG. 4 is a longitudinal section view through the nozzle, taken along line 4—4 in FIG. 3.

An exemplary nozzle 34 is shown in FIG. 3 in perspective, and in FIG. 4 in cross section. The shaft 137 of the nozzle 34 is sufficiently narrow to fit within the open top 130 of the smallest container opening to be serviced by the filling machine. The valve 135 is opened by contact between the top edge of the container 22 and a radially protruding flange 143 that is large enough to encounter the edge of the largest container opening to be serviced.

One or more flowpaths are defined axially through the nozzle 34. In the embodiment shown, a first flowpath 139 is provided for discharging material from the source 65 into the container 22, and a second flowpath 141 is defined for applying suction to remove air that is displaced as the container 22 is filled. The second flowpath 141 can also be used to flush out the containers of dust or to suction out any particles therein.

The second flowpath 141 is not arranged to open and close, and preferably is coupled to a suitably controlled source of pressure or vacuum for moving air into or out of the container 22. The first flowpath 139, however, is opened when the top edge of the container 22 pushes the flange 143, and the movable sleeve 145 fixed thereto, upwardly on the shaft 137 of the nozzle 34 to uncover radial openings 147 leading from the first flowpath in the shaft, outwardly into the container 22. When no container is present, biasing spring 149 pushes sleeve 145 downwardly to cover openings 147.

In the embodiment shown in FIG. 4, the nozzles 34 include a guide bore 152 that receives a positioning shaft 160. There are a number of alternative ways to position the nozzles 34 in the X and Y directions parallel to the plane of the array. A threaded positioning shaft 160 can be provided for each nozzle 34, with the guide bore being threaded for receipt of the shaft and the shaft being rotated by a predetermined time or number of revolutions to achieve a corresponding displacement. A reversible drive motor 162 can be provided, and operated by a computer or other controller which is programmed to move the nozzles between or among the required positions needed to run two or more different sizes of containers 22. In this manner the nozzle 22 can be moved forward and backward along the axis of the guide bore 152.

The actuator means 90 preferably comprises at least one drive such as a motor operable controllably to advance and retract the nozzles 34 along at least one of the X and Y axes. The motor can be a synchronous gear motor operated for a predetermined time to move a given distance, or a stepping motor, etc. It is also possible, for example if only two different container sizes are to be serviced, to use a solenoid drive for moving the nozzles 34 between two discrete positions, the spacing being defined by the stroke of the solenoid.

Figure 5:
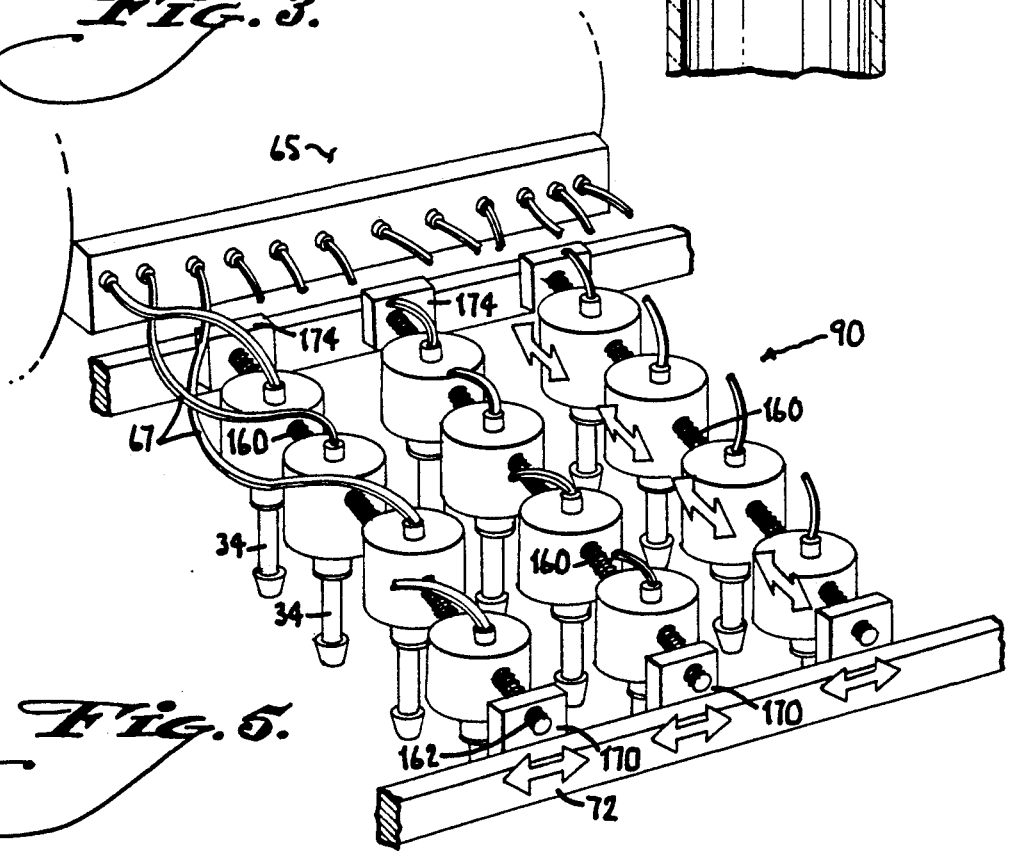
FIG. 5 is a schematic perspective view showing an X-Y nozzle positioning arrangement according to the invention.

It is possible to include a separate motor 162 for each of the two axes of movement of each nozzle 34. This may be expensive, and in fact is not necessary. Preferably a mechanical coupling is arranged such that the rotation of one motor for either or both of the X and Y axes is coupled to move all the nozzles 34 by the required amount. However, the different nozzles in the array must be moved by different distances in order to change from one container size to another. Referring to FIG. 5, all the nozzles in a given row or column can be carried on a support which has one motor or the like arranged to position the whole row or column. In FIG. 5, the nozzles 34 are carried on lateral support bars 170 arranged to set the position of a row of nozzles. At least one row/column motor 172 moves the support bar 170 back and forth along the walls of the framework for the nozzle support structure. The individual nozzle housings comprise means for varying the position of the respective nozzle 34 on its lateral support bar 170, such as a motor arranged to frictionally engage the bar.

One means for positioning the individual nozzle housings along the guide bar or shaft 170 using a single motor is to provide a disengageable screw thread coupling. According to this arrangement, each of the guide bars 170 can be threaded and arranged to rotate via a motor at an end block 174 (which can also contain a motor for moving the end block back and forth in a direction perpendicular to the axis of the guide bar 170). Via computer control of solenoids in the nozzle housings that either engage the thread of the guide bar 170 or release the guide bar, the individual nozzles on each bar are positioned. When a nozzle is to be moved, its solenoid engages the thread, whereupon rotation of the threaded guide bar moves the nozzle axially along the guide bar in one direction or the other. This can be done one nozzle at a time, e.g., such that when a next nozzle is to be moved the solenoid of the previous nozzle releases the thread and the previous nozzle remains in position notwithstanding rotation of the guide bar to move the next nozzle. Alternatively, all the nozzles can engage the thread of the guide bar initially, and those having a shorter displacement simply disengage from the guide bar thread sooner. This arrangement is a combination of individual nozzle positioning and an arrangement wherein the nozzles rows and columns are advanced commonly by a motor drive or the like operating on all the nozzles in at least one of the rows and the columns.

Figure 6:
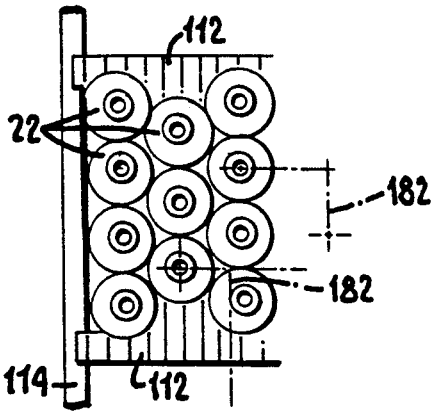
FIG. 6 is a plan view showing relatively smaller size containers arranged in a packed array.
Figure 7:
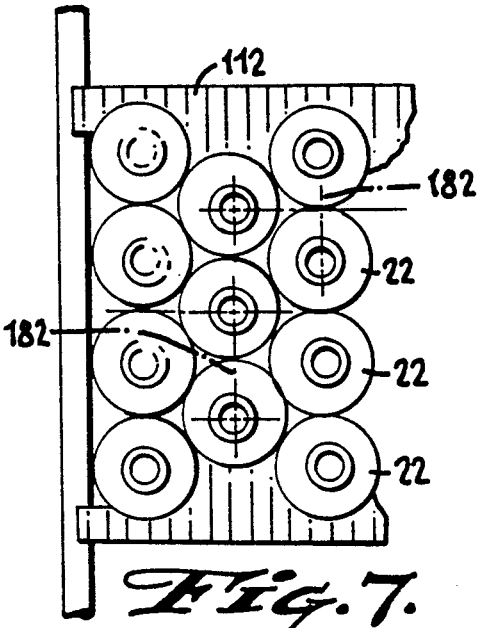
FIG. 7 is a plan view corresponding to FIG. 6 and showing relatively larger containers, the displacement of one of the nozzles between FIGS. 6 and 7 being shown in broken lines.

FIGS. 6 and 7 compare the required container positions for containers 22 of different sizes. Using the same number of containers and nozzles, the array in FIG. 6 is smaller than that of FIG. 7. It is also possible to use different numbers of nozzles 22 (more for smaller containers) if the unused nozzles (when running larger containers) can be moved out of the way.

In the example shown in FIGS. 6 and 7, the necessary displacements for two of the nozzles between the arrays shown is illustrated by broken lines 182. It is apparent from lines 182 that the individual nozzles move different distances. In each case the contoured or scalloped side bars have urged the array into a packed arrangement. For a job change between container sizes, the nozzles are repositioned as shown and the contoured side bars 112 are replaced or selected for the new container size. A plurality of selectably movable sidebars 112 can be installed and selected under machine control, or a new side bar 112 can be put in place as a part of a job change.

Figure 8:
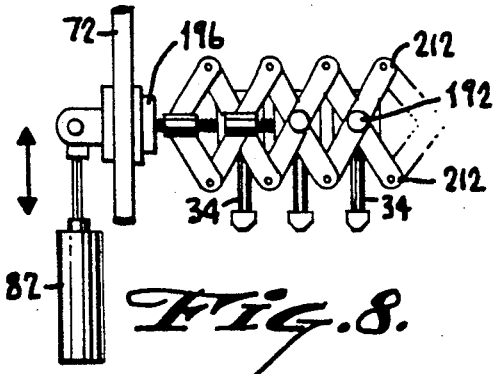
FIG. 8 is a partial side elevation showing a pantograph arrangement for positioning the nozzles along one of the axes.
Figure 9:
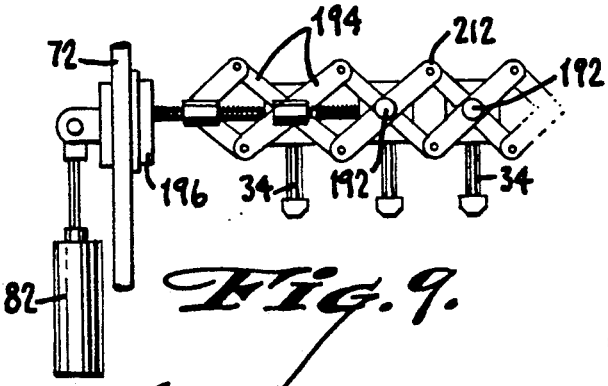
FIG. 9 is a plan view showing mutually perpendicular pantograph arrangements operable to position the nozzles by common displacement of rows and columns.

FIGS. 8 and 9 represent another alternative for positioning a plurality of nozzles 34 using a single drive means. In this arrangement the nozzles 34 are carried at the junctions 192 of pantograph connecting arms 194, i.e., a structure of arms coupled to form parallelograms which can be opened or collapsed to vary the elongation of the structure. A motor 196 is operable to shorten or lengthen the distance between adjacent junctions 192 of the pantograph connecting arms 194, which are pivotally coupled at the junctions. Whereas all the connecting arms 194 are coupled together down the line, the pantograph spaces all the nozzles 34 by an equal amount, and thus moves each of the individual nozzles by a different distance than its neighbors, as needed to assume the new array. Once spaced, the vertical drive means 46 in FIG. 8 moves the positioned nozzles 34 into engagement with the containers 22. For changing between the container sizes of FIGS. 6 and 7, the pantograph arrangement is displaced approximately by the amounts shown in FIGS. 8 and 9.

The pantograph arrangement can be applied to an embodiment wherein both the row and column spacings are controlled by single motors or by gearing coupled to a single motor, whereby the overall array of nozzles can be enlarged and contracted. A column positioning pantograph 202 varies the spacing of guide bars 204 for the columns of nozzles 34, the guide bars passing slidably through the nozzle housings. A row positioning pantograph 206 varies the spacing of the nozzles 34 on the column guide bars 204, via row guide bars 208 that slidably pass through the nozzle housings at a position which does not interfere with the column guide bars.

Figure 10:
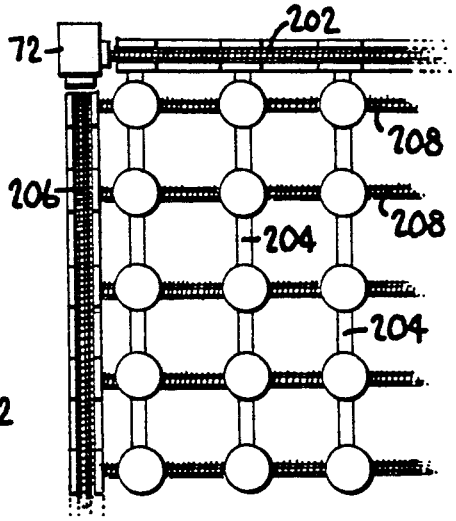
FIG. 10 is a plan view of the embodiment according to FIG. 9.

The array of nozzles in FIG. 10 is not staggered. It is possible to arrange for staggered positioning of adjacent rows or columns to accommodate the type of array shown in FIGS. 6 and 7. For this purpose, every other guide bar can be carried on a central pantograph joints 192 and the others of the guide bars can be carried on the intermediate pantograph joints 212. The spacing between the intermediate pantograph joints 212 changes as the structure is elongated and contracted. Therefore, in order to maintain a constant vertical position of all the nozzles 34 in the array, it is necessary to support the staggered nozzles (those on guide bars 212) vertically and to couple the nozzles to the intermediate pantograph joints 212 via a fitting that allows the joints 212 to slide vertically relative to the housing of the respective nozzle 34.

As shown in FIGS. 6 and 7, the columns of the packed array define straight lines of containers 22, but the rows are not straight. If it is necessary to use row guide bars 208 that are staggered and to use the intermediate pantograph joints 212 for X-Y positioning, the column guide bars 204 (which are straight) will provide the necessary vertical support to avoid a problem due to the slide fittings at the intermediate pantograph joints of the row guide bars 208. All the column guide bars 204 can be mounted at the centerline pantograph joints 192, which do not change in vertical position and thus maintain the vertical position of the nozzles 34.

The foregoing examples are discussed using terms such as rows, columns, longitudinal, lateral, etc. It will be appreciated that the containers 22 need not be aligned in any particular orientation relative to the direction 102 of conveyor advance, provided they are positioned at predetermined positions in registry with the nozzles 34.

The invention having been disclosed in connection with certain preferred embodiments as examples, variations within the scope of the invention will now be apparent to persons skilled in the art. The invention is not intended to be limited to the preferred examples. Accordingly, reference should be made to the appended claims rather than the foregoing embodiments to assess the scope of exclusive rights in the invention claimed.

I claim:

1. A filling machine for filling arrays of equally sized containers, said filling machine being adjustable to fill at least two different sized containers, each of the containers of said different sizes are such that the distance between the centers of at least any three containers in an X-Y array are equally spaced and at least two of said three containers are laterally abutting one another and wherein said filling machine has a longitudinal axis in the x-direction and a lateral axis in the y-direction, the filling machine comprising:

means for supporting the containers in an upright orientation with the containers occupying a plurality of evenly spaced laterally abutting container positions, forming an array of evenly spaced abutting containers of which the centers intersect a plurality of parallel longitudinal axes intersected by a plurality of parallel lateral axes perpendicular thereto;

a plurality of nozzles coupled to a source of material to be discharged into the containers, the nozzles being movably mounted on a fill station structure for occupying nozzle positions in registry with said evenly spaced container positions; and, actuator means mounted on the fill station structure, operable to displace the nozzles along both the longitudinal axes and long the lateral axes perpendicular thereto, thereby being operable to alter the nozzle positions for achieving at least two alternative spacings of the nozzles corresponding to the centers of the containers of said at least two different sizes, along both said longitudinal axes and said lateral axes.

2. The filling machine according to claim 1, wherein the actuator means is motorized.

3. The filling machine according to claim 2, wherein the means for supporting the containers comprises at least one laterally movable bar operable to urge the containers inwardly in the array for achieving said evenly spaced container positions by.

4. The filling machine according to claim 3, wherein the laterally movable bar is contoured to define evenly spaced receptacles for containers along a periphery of the array, whereby movement of the bar positions the containers along both said axes.

5. The filling machine according to claim 2, wherein the fill station structure includes a fixed support and a movable support thereon, and drive means operable to raise and lower the movable support relative to the containers, the nozzles being mounted on the movable support and each of the nozzles including a valve operable to be opened by a respective container in registry therewith, for discharging only into container positions in the array that are occupied by a container.

6. The filling machine according to claim 2, further comprising at least one of a pressure source and a suction source coupled to the nozzles, said pressure source and suction source being arranged for at least one of flushing the containers for cleaning, suctioning the containers for removing foreign particles, forcing said material from the source into the containers, and suctioning from the containers air displaced by the material discharged into the containers.

7. The filling machine according to claim 6, wherein the pressure and suction sources are coupled to the nozzles and to the source of material, for simultaneously forcing the material from the source into the containers by pressure and suctioning from the containers air displaced by the material discharged into the containers.

8. A filling machine for filling containers of equal sizes, said filling machine being adjustable to fill at least two different sized containers, comprising:

means for supporting the containers in an upright orientation with the containers occupying a plurality of evenly spaced container positions along at least one longitudinal axis of an array of the containers;

a plurality of nozzles coupled to a source of material to be discharged into the containers, the nozzles being movably mounted on a fill station structure for occupying nozzle positions in registry with said evenly spaced container positions;

actuator means mounted on the fill station structure and operable to displace at least a subset of the nozzles along both the longitudinal axis, the actuator means being operable to alter the nozzle positions for achieving at least two alternative spacings of the nozzles, corresponding to evenly spaced container positions of containers of at least two different sizes;

wherein the means for supporting the containers in an upright orientation is further arranged such that the containers occupy a plurality of evenly spaced container positions in an X-Y array defined by a plurality of perpendicular axes, said subset of nozzles being displaceable by the actuator means for altering the nozzle positions along both of said axes for achieving the at least two alternative spacings of the nozzles; and, wherein the actuator means comprises at least one motor drive operable controllably to advance and retract the nozzles along at least one of said axes.

9. The filling machine according to claim 8, wherein the nozzles are arranged in rows and columns and wherein the motor drive is operable to advance and retract all the nozzles in at least one of the rows and the columns commonly.

10. The filling machine according to claim 8, wherein the actuator means is arranged in rows and columns, and includes at least one first spacing driver operable to space a plurality of nozzles in a plurality of said rows and at least one second spacing driver operable to space a plurality of nozzles in at least one column.

11. The filling machine according to claim 10, wherein the second spacing driver is operable to space a plurality of nozzles in a plurality of said columns.

12. The filling machine according to claim 8, wherein the actuator means comprises at least one threaded rod coupled for rotation by a motor, the threaded rod engaging a nut for positioning at least one said nozzle, one of the motor and the nut being fixed relative to said nozzle and the other of the motor and the nut being fixed relative to said axes.

13. The filling machine according to claim 8, wherein the nozzles are coupled to the source of material via flexible couplings for permitting displacement of the nozzles while maintaining a coupling for flow of the material from the source.

14. A filling machine for filling equally sized containers, said filling machine being adjustable to fill containers of at least two different sizes in bulk, comprising:

a depalletizer operable periodically to provide said containers in a group with a plurality of upright containers along mutually perpendicular axes, the containers defining an X-Y array;

a means for supporting and moving the containers in an upright orientation while in said X-Y array;

at least one movable engagement bar operable to compress the array of containers laterally, whereupon the containers occupy a plurality of evenly spaced laterally abutting container positions, forming an array of evenly spaced abutting containers of which their centers intersect a plurality of parallel longitudinal axes intersected by a plurality of parallel lateral axes perpendicular thereto;

a plurality of nozzles coupled to a source of material to be discharged into the containers, the nozzles being movably mounted on a fill station structure for occupying nozzle positions in registry with said evenly spaced container positions; and, actuator means mounted on the fill station structure and operable to displace at least a subset of the nozzles, the actuator means being controllable to alter the nozzle positions by changing from one spacing to another along both of said longitudinal axes and said lateral axes perpendicular thereto for achieving at least two alternative spacings of the nozzles, each spacing corresponding to evenly spaced container positions of containers for a given size container, chosen from said at least two different sizes.

15. The filling machine according to claim 14, wherein the movable engagement bar is contoured to define evenly spaced receptacles for containers along a periphery of the array of evenly spaced containers whereby movement of the bar positions the containers along both said axes.

16. The filling machine according to claim 15, wherein the fill station structure includes a fixed support and a movable support thereon, and drive means operable to raise and lower the movable support relative to the containers, the nozzles being mounted on the movable support and each of the nozzles including a valve operable to be opened by a respective container in registry therewith, for discharging only into container positions in the array that are occupied by a container.

17. A filling machine for filling equally sized containers, said filling machine being adjustable to fill at least two different sized containers in bulk, comprising:

a depalletizer operable periodically to provide said containers in a group with a plurality of upright containers along mutually perpendicular axes, the containers defining an X-Y array;

a means for supporting and moving the containers in an upright orientation while in said X-Y array;

at least one movable engagement bar operable to compress the array of containers laterally, whereupon the containers occupy a plurality of evenly spaced laterally abutting container positions, forming an array of evenly spaced abutting containers of which their centers intersect a plurality of parallel longitudinal axes intersected by a plurality of parallel lateral axes perpendicular thereto;

a plurality of nozzles coupled to a source of material to be discharged into the containers, the nozzles being movably mounted on a fill station structure for occupying nozzle positions in registry with said evenly spaced container positions; and, actuator means mounted on the fill station structure and operable to displace at least a subset of the nozzles, the actuator means being controllable to alter the nozzle positions for achieving at least two alternative spacings of the nozzles, corresponding to evenly spaced container positions for a given size container, chosen from said at least two different sized containers;

wherein the movable engagement bar is contoured to define evenly spaced receptacles for containers along a periphery of the array of evenly spaced containers, whereby movement of the bar positions the containers along both of said longitudinal and lateral axes;

wherein the fill station structure includes a fixed support and a movable support thereon, and drive means operable to raise and lower the movable support relative to the containers, the nozzles being mounted on the movable support and each of the nozzles including a valve operable to be opened by a respective container in registry therewith, for discharging only into container positions in the array that are occupied by a container; and, wherein the actuator mans comprises at least one motor drive operably controllably to advance and retract the nozzles along at least one of said longitudinal and lateral axes.

18. The filling machine according to claim 17, wherein the nozzles are coupled to the source of material via flexible couples for permitting displacement of the nozzles while maintaining a coupling for flow of the material from the source.

* * * * *

UNITED STATES PATENT AND TRADEMARK OFFICE

CERTIFICATE OF CORRECTION

PATENT NO. : 5,305,809

DATED : April 26, 1994

INVENTOR(S) : Frank G. Pringle

It is certified that error appears in the above-indentified patent and that said Letters Patent is hereby corrected as shown below:

In the abstract, line 2, "examples" should read --example--.

Column 2, line 23, "f it" should read --fit--.

Column 10, line 62, "long" should read --along--.

Column 10, line 68, insert --perpendicular thereto-- after "axes".

Column 11, line 7, after --positions--, insert --.-- and delete "by".

Column 14, line 24, "mans" should read --means--.

Signed and Sealed this

Sixth Day of September, 1994

*Attest:*

Bruce Lehman

BRUCE LEHMAN

*Attesting Officer*

*Commissioner of Patents and Trademarks*